US006997539B2

(12) United States Patent
Hoisington et al.

(10) Patent No.: US 6,997,539 B2
(45) Date of Patent: Feb. 14, 2006

(54) APPARATUS FOR DEPOSITING DROPLETS

(75) Inventors: Paul A. Hoisington, Norwich, VT (US); Melvin L. Biggs, Norwich, VT (US); Andreas Bibl, Los Altos, CA (US)

(73) Assignee: Dimatix, Inc., Lebanon, NH (US)

( * ) Notice: Subject to any disclaimer, the term of this patent is extended or adjusted under 35 U.S.C. 154(b) by 0 days.

(21) Appl. No.: 10/462,093

(22) Filed: Jun. 13, 2003

(65) Prior Publication Data

US 2004/0252155 A1 Dec. 16, 2004

(51) Int. Cl.
*B41J 2/165* (2006.01)
*B41J 2/01* (2006.01)

(52) U.S. Cl. ..... 347/25; 347/102

(58) Field of Classification Search ..... 347/22, 347/25, 34, 102, 104, 8, 37; 400/690, 693; 101/424.1, 480, 487

See application file for complete search history.

(56) References Cited

U.S. PATENT DOCUMENTS

| | | | | |
|---|---|---|---|---|
| 4,106,032 A | | 8/1978 | Miura et al. | |
| 4,223,324 A | * | 9/1980 | Yamamori et al. | 347/21 |
| 4,591,873 A | * | 5/1986 | McCann et al. | 347/25 |
| 4,613,875 A | | 9/1986 | Le et al. | |
| 4,937,598 A | | 6/1990 | Hine et al. | |
| 4,940,995 A | | 7/1990 | Hine et al. | |
| 4,947,184 A | | 8/1990 | Moynihan | |
| 4,959,662 A | | 9/1990 | Kobayashi | |
| 4,995,940 A | | 2/1991 | Hine et al. | |
| 5,065,169 A | | 11/1991 | Vincent et al. | |
| 5,155,498 A | | 10/1992 | Roy et al. | |
| 5,381,162 A | | 1/1995 | Roy et al. | |
| 5,742,313 A | | 4/1998 | Hine | |
| 6,281,912 B1 | | 8/2001 | Silverbrook | |
| 6,659,602 B2 | * | 12/2003 | Izawa et al. | 347/102 |
| 6,890,053 B2 | * | 5/2005 | Myhill et al. | 347/25 |

FOREIGN PATENT DOCUMENTS

| | | |
|---|---|---|
| EP | 0 604 029 A2 | 6/1994 |
| JP | 3-234539 | 10/1991 |
| JP | 10-138461 | 5/1998 |
| JP | 10-153453 | 6/1998 |

* cited by examiner

*Primary Examiner*—Shih-Wen Hsieh
(74) *Attorney, Agent, or Firm*—Fish & Richardson P.C.

(57) ABSTRACT

An apparatus for depositing droplets on a substrate, the apparatus includes a support for the substrate, a droplet ejection assembly positioned over the support for depositing the droplets on the substrate on the support, an enclosure structure defining with the support an enclosed region through which the droplets are ejected onto the substrate, the enclosure structure also defining with the support an inlet gap and an outlet gap through which the substrate travels and a source of pressurized gas connected to the enclosure structure to provide a flow of gas from the enclosure structure through the gaps.

33 Claims, 3 Drawing Sheets

APPARATUS FOR DEPOSITING DROPLETS

TECHNICAL FIELD

This invention relates to depositing droplets on a substrate.

BACKGROUND

Ink jet printers are one type of apparatus for depositing droplets on a substrate. Ink jet printers typically include an ink path from an ink supply to a nozzle path. The nozzle path terminates in a nozzle opening from which ink drops are ejected. Ink drop ejection is controlled by pressurizing ink in the ink path with an actuator, which may be, for example, a piezoelectric deflector, a thermal bubble jet generator, or an electrostatically deflected element. A typical print assembly has an array of ink paths with corresponding nozzle openings and associated actuators. Drop ejection from each nozzle opening can be independently controlled. In a drop-on-demand print assembly, each actuator is fired to selectively eject a drop at a specific pixel location of an image as the print assembly and a printing substrate are moved relative to one another. In high performance print assemblies, the nozzle openings typically have a diameter of 50 microns or less, e.g. around 25 microns, are separated at a pitch of 100–300 nozzles/inch, have a resolution of 100 to 3000 dpi or more, and provide drops with a volume of about 1 to 70 picoliters (pl) or less. Drop ejection frequency is typically 10 kHz or more.

Hoisington et al. U.S. Pat. No. 5,265,315, the entire contents of which are hereby incorporated by reference, describes a print assembly that has a semiconductor body and a piezoelectric actuator. The body is made of silicon, which is etched to define ink chambers. Nozzle openings are defined by a separate nozzle plate, which is attached to the silicon body. The piezoelectric actuator has a layer of piezoelectric material, which changes geometry, or bends, in response to an applied voltage. The bending of the piezoelectric layer pressurizes ink in a pumping chamber located along the ink path. Piezoelectric ink-jet print assemblies are also described in Fishbeck et al. U.S. Pat. No. 4,825,227 and Hine U.S. Pat. No. 4,937,598, the entire contents of which are incorporated by reference.

Printing accuracy is influenced by a number of factors, including the size and velocity uniformity of drops ejected by the nozzles in the assemblies and among multiple assemblies in a printer. The drop size and drop velocity uniformity are in turn influenced by factors such as the dimensional uniformity of the ink paths, acoustic interference effects, contamination in the ink flow paths, and the actuation uniformity of the actuators.

Commercial printing paper can have loose particles that can reduce printing quality.

SUMMARY

One aspect of the invention features, in general, an apparatus for depositing droplets on a substrate. The apparatus includes a support for the substrate, a droplet ejection assembly positioned over the support for depositing the droplets on the substrate, an enclosure structure and a source of pressurized gas connected to the enclosure structure. The enclosure structure together with the support define an enclosed region through which the droplets are ejected onto the substrate. The enclosure structure together with the support also define an inlet gap and an outlet gap through which the substrate travels. The pressurized gas connected to the enclosure structure provides a flow of gas from the enclosure structure through the gaps.

In some implementations, the enclosure structure includes an enclosure disposed above the droplet ejection assembly. The inlet and outlet gaps and the gas pressure may be adjusted to deliver the gas through the gap at a velocity greater than that of the substrate. The inlet and outlet gap may be between about 0.006 to about 0.100 inch for a 0.004 inch substrate. It may be advantageous to remove particulate matter and moisture form the source of pressurized gas. In some cases, it may be advantageous to add water or other solvent to the source of pressurized gas. In some cases, the pressure of the pressurized gas is from about 0.1 inch to about 10 inches water above normal atmospheric pressure.

In other implementations, the enclosure structure includes a manifold distribution system to deliver the pressurized gas to respective slits adjacent to each gap.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
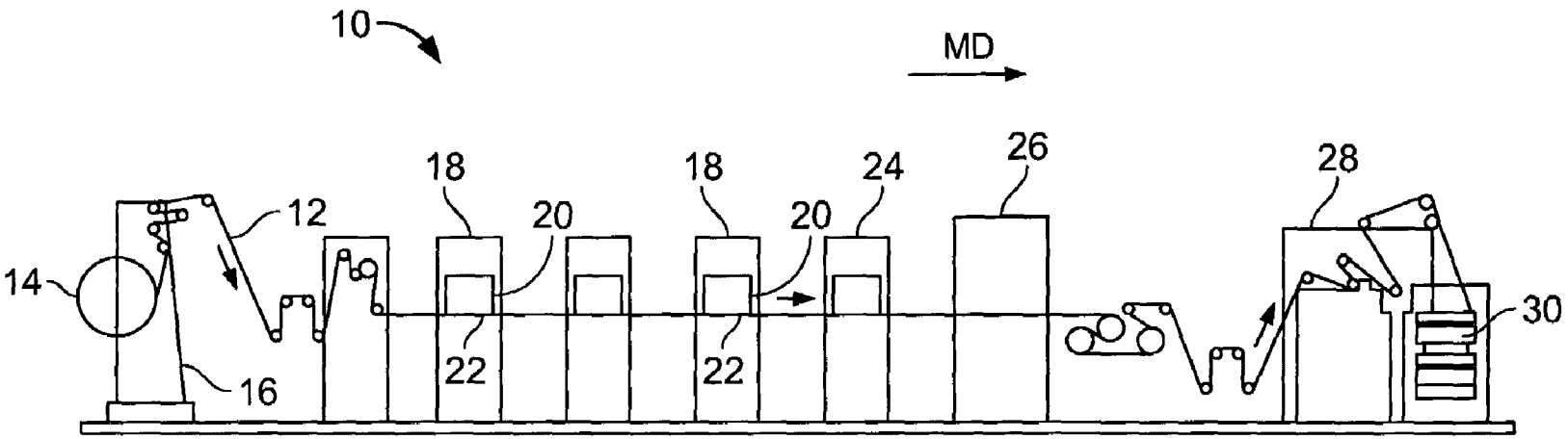
FIG. 1 is a diagrammatic side view of an apparatus for printing on a substrate.

FIG. 1 illustrates apparatus 10 for continuously depositing ink droplets on a substrate 12 (e.g. paper). Substrate 12 is pulled from roll 14 that is on supply stand 16 and fed to a series of droplet-depositing stations 18 for placing a plurality of different colored droplets on substrate 12. Each droplet-depositing station 18 has a stationary droplet ejection assembly 20 positioned over the substrate 12 for depositing droplets on the substrate 12. Below the substrate 12 at each depositing station 18 is a substrate support structure 22 (e.g. a porous platen). After the substrate 12 exits the final depositing station 24, it may go to a pre-finishing station 26. The pre-finishing station 26 may be used for drying the substrate 12. It may also be used for UV or other radiation curing of the substrate 12. Next, the substrate 12 travels to the finishing station 28, where it is folded and slit into finished product 30. The substrate feed rate is approximately 0.25–5.0 meters/sec or higher. The droplet ejection assembly may eject droplets of ink. It may also eject a UV curable material, a radiation curable material or other material capable of being delivered as droplets.

Figure 2:
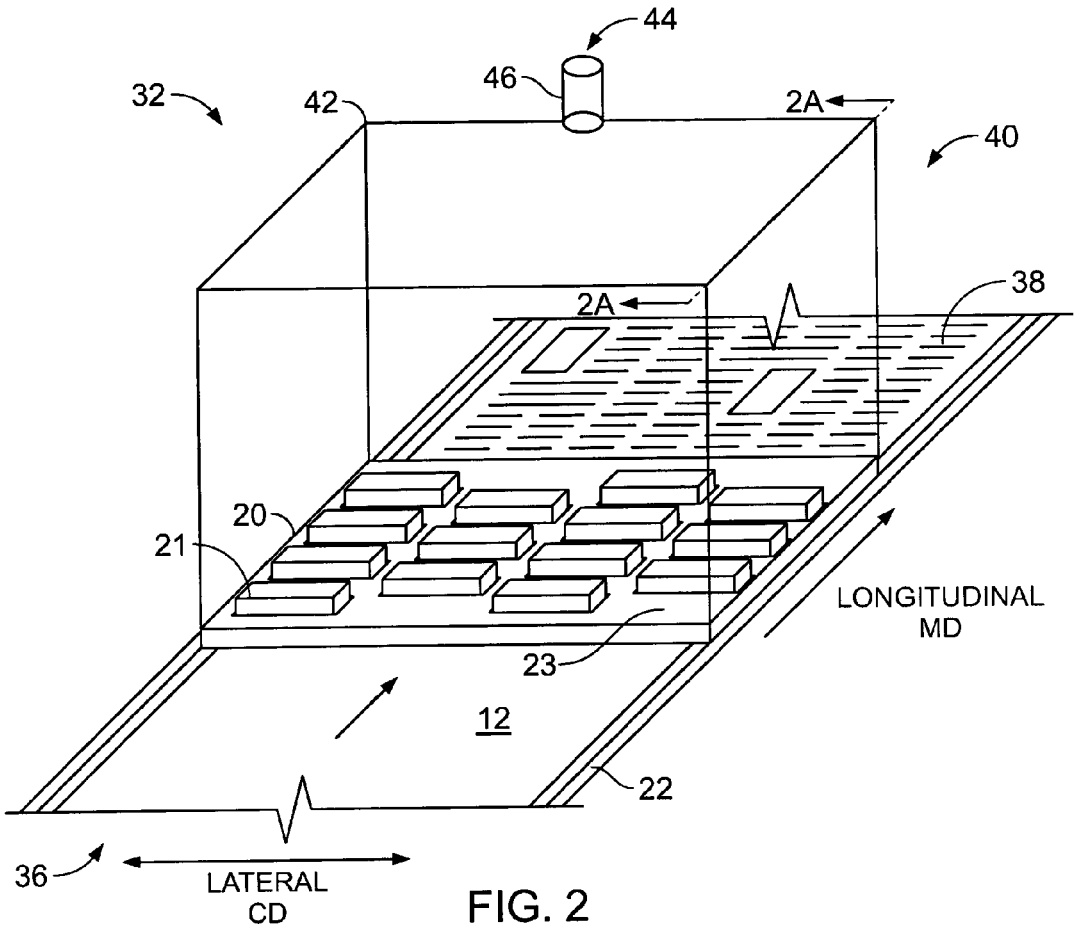
FIG. 2 is a perspective view of a print station shown in FIG. 1.

FIG. 2 shows an apparatus 32 with a printable substrate 12 traveling in the longitudinal machine direction under a droplet ejection assembly 20. In this embodiment, the droplet ejection assembly 20 is made up of a plurality of discrete print units 21 mounted and sealed in a print unit support 23. The un-printed substrate 12 enters the inlet side 36 and the printed substrate 38 exits the outlet side 40. Substrate support structure 22 (e.g. a porous platen) supports the printable substrate 12. The substrate support structure 22 may also be a curved, non-porous platen or a rotating drum (not shown). Mounted over the droplet ejection assembly is an enclosure 42 for accepting a pressurized gas 44 through inlet 46.

Figure 2A:
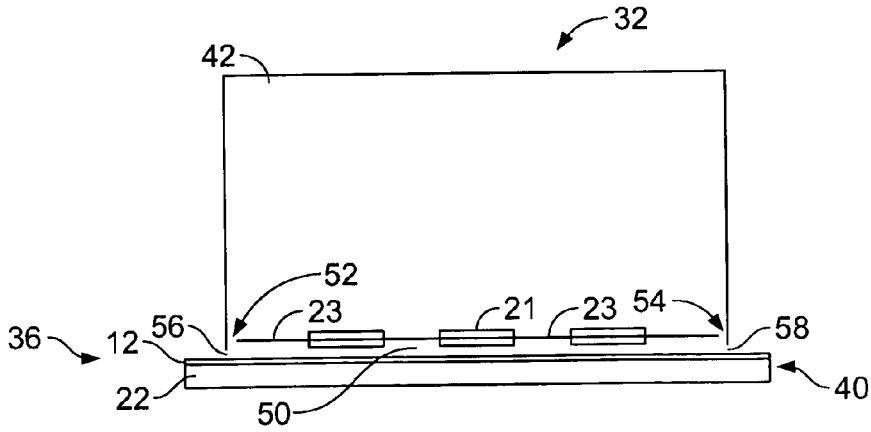
FIG. 2A is a cross-sectional view of the print station shown in FIG. 2, taken along 2A—2A.

FIG. 2A shows the apparatus shown in FIG. 2, taken along 2A—2A. Pressurized gas entering enclosure 42 travels to a proximal edge 52 and a distal edge 54 of an enclosed region 50, defined by the print unit support 23 and support structure 22. From here, the pressurized gas exits the paper inlet gap 56 and the paper outlet gap 58. This type of construction can remove debris before it has the chance to enter the print zone. In addition, the pressurized gas can help hold the substrate flat against the support structure. Pressure in enclosure 42 is between from about 0.1 inch to about 10 inches of water above nominal atmospheric pressure. Having both paper inlet gap 56 and paper outlet gap 58 keeps the pressure in balance under the enclosed region 50, for example, to reduce the risk of paper jams.

The gas pressure should be adjusted so that the gas velocity through the gap is between about 0.25 to about 5 meters/sec. If the gas pressure gets too high, the image may get damaged, the power requirements may become restrictive and there may be excessive noise. Excessive noise can be caused by turbulent flow and as the velocity gets higher, the turbulence becomes greater and, thus, the noise becomes greater. The power required for a given flow rate is proportional to the flow of the gas so that as the flow rate becomes higher, the power requirements become greater.

The inlet gap is from about 0.006 to about 0.100 inch and the outlet gap is from about 0.006 to about 0.100 inch for a 0.004 inch substrate (e.g. paper). If the gaps become too large, power requirements may become restrictive and if the gaps become too small the image may become smeared or there might be a paper jam.

The substrate may be paper, plastic or other printable substrate. Typical substrates are approximately 0.002 to about 0.008 inch thick.

The pressurized gas may be filtered, for example with a HEPA filter, to remove particulate matter and excessive moisture. In some cases, water or other solvent may be added to prevent clogging of the droplet ejection assembly. In some cases, an inert gas environment may be required to aid in curing the droplets. In other cases, other gases may be required to aid in the curing of the droplets.

Figure 3:
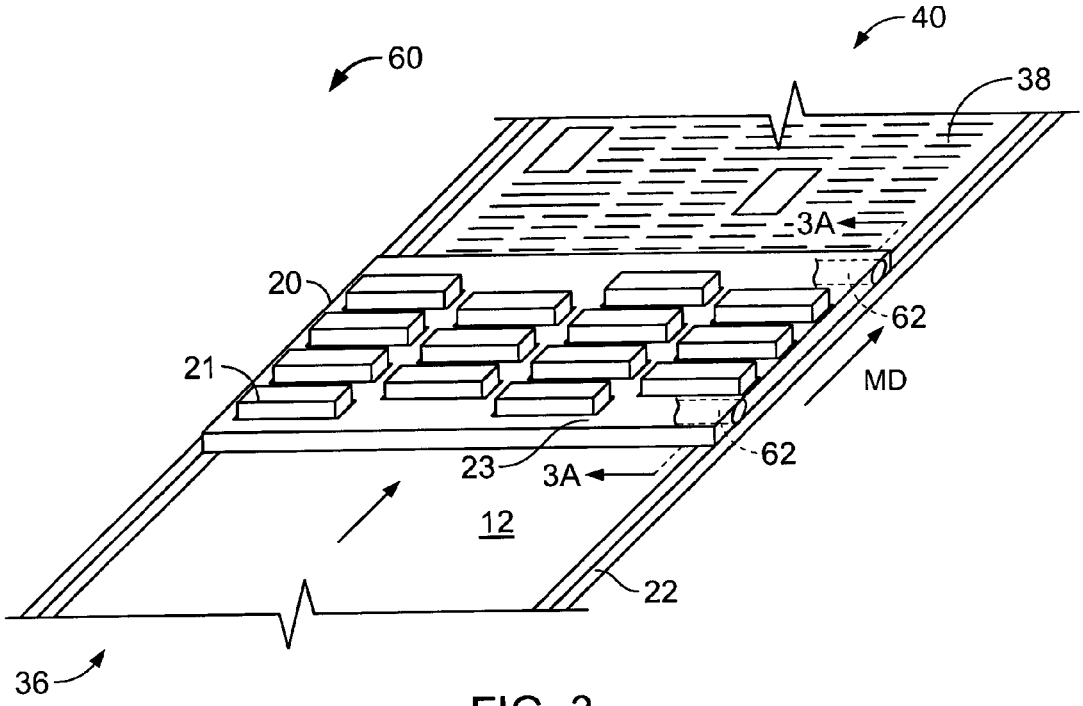
FIG. 3 is a perspective view of an alternative print station.
Figure 3A:
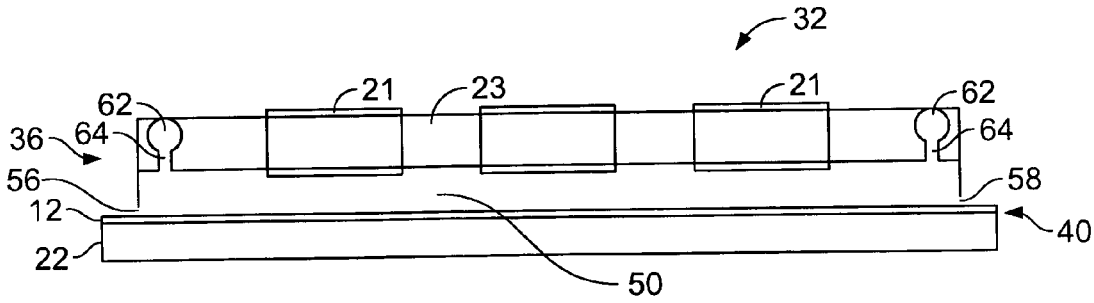
FIG. 3A is a cross-sectional view of the print station shown in FIG. 3, taken along 3A—3A.

FIG. 3 shows an alternative apparatus 60 for clearing the print path. In this embodiment, the pressurized gas is delivered to a manifold distribution system 62 included in the print unit support 23. FIG. 3A shows the alternative apparatus 60, taken along line 3A—3A and illustrates that the pressurized gas travels from the manifold distribution system 62 through a slit 64 in the distribution system. In this embodiment, the slit 64 continues along the entire lateral length of the print unit support 23. Slit 64 delivers pressurized gas to the enclosed region 50 and then to the paper inlet gap 56 and the paper outlet gap 58.

The inlet and outlet gaps are adjusted together with the gas pressure and slit width so that the gas velocity through the gaps preferably is about 1.0 meters/sec.

The inlet gap and the outlet gaps are from about 0.006 to about 0.100 inch for a 0.004 substrate (e.g. paper).

A number of embodiments of the invention have been described. Nevertheless, it will be understood that various modifications may be made without departing from the spirit and scope of the invention. For example, the apparatus illustrated in FIG. 3 may be altered by utilizing a plurality of apertures (not shown) in the print unit support 23 instead of slits 64 to convey the pressurized gas to enclosed region 50. The apertures can be constructed so that the pressurized gas does not interfere with the depositing of droplets on the substrate 12. The deposited droplets can be ink or other materials. For example, the deposited droplets may be a UV or other radiation curable material or other material capable of being delivered as droplets. Accordingly, other embodiments are within the scope of the following claims.

What is claimed is:

1. An apparatus for depositing droplets on a substrate, the apparatus comprising:

a support for said substrate;

a droplet ejection assembly positioned over said support for depositing said droplets on said substrate on said support;

an enclosure structure defining with said support an enclosed region through which said droplets are ejected onto said substrate, said enclosure structure also defining with said support an inlet gap and an outlet gap through which said substrate travels; and a source of pressurized gas connected to said enclosure structure to provide a flow of gas from said enclosure structure through the gaps.

2. The apparatus of claim 1 wherein said enclosure structure comprises an enclosure disposed above said droplet ejection assembly.

3. The apparatus of claim 2 wherein the pressure of said pressurized gas is from about 0.1 inch to about 10 inches water above nominal atmospheric pressure.

4. The apparatus of claim 2 wherein said inlet gap is from about 0.006 to about 0.100 inch.

5. The apparatus of claim 2 wherein said outlet gap is from about 0.006 to about 0.100 inch.

6. The apparatus of claim 1 wherein said enclosure structure comprises a manifold distribution system to deliver said pressurized gas to respective slits adjacent each gap.

7. The apparatus of claim 6 wherein the pressure of said pressurized gas is from about 0.1 inch to about 10 inches of water above nominal atmospheric pressure.

8. The apparatus of claim 6 wherein said inlet gap is from about 0.006 to about 0.100 inch.

9. The apparatus of claim 6 wherein said outlet gap is from about 0.006 to about 0.100 inch.

10. The apparatus of claim 1 wherein said droplets comprise ink.

11. The apparatus of claim 1 wherein said substrate comprises paper.

12. The apparatus of claim 1 further comprising a continuously moving substrate.

13. The apparatus of claim 1 further comprising a filer that removes particulate mater from said source of pressurized gas.

14. The apparatus of claim 1 further comprising adding moisture to said source of pressurized gas.

15. The apparatus of claim 1 further comprising adding solvent to said source of pressurized gas.

16. The apparatus of claim 1 wherein said gap and said pressure are sized to deliver said gas through the gap at a velocity greater than that of said substrate.

17. The apparatus of claim 1 wherein the gas is air.

18. The apparatus of claim 17 wherein the gas has an oxygen content less than that of air.

19. The apparatus of claim 17 wherein the gas has an oxygen content greater than that of air.

20. The apparatus of claim 1 wherein said inlet gap is from about 0.006 to about 0.100 inch.

21. The apparatus of claim 1 wherein the outlet gap is from about 0.006 to about 0.100 inch.

22. The apparatus of claim 1 wherein said gap and said pressure are sized to flatten said substrate against said support.

23. The apparatus of claim 1 wherein the support is continuous.

24. The apparatus of claim 23 wherein the continuous support comprises a porous platen.

25. An apparatus for depositing droplets on a substrate, the apparatus comprising:

a support for said substrate;

a droplet ejection assembly positioned over said support for depositing said droplets on said substrate on said support; and an enclosure structure defining with said support an enclosed region through which said droplets are ejected onto said substrate, said enclosure structure also defining with said support an inlet gap and an outlet gap through which said substrate travels, said enclosure structure configured to receive a source of pressurized gas to provide a flow of gas from said enclosure structure through the gaps.

26. The apparatus of claim 25 wherein the support is continuous.

27. The apparatus of claim 26 wherein the continuous support comprises a porous platen.

28. An apparatus for depositing droplets on a substrate, the apparatus comprising:

a support for said substrate;

a droplet ejection assembly positioned over said support for depositing said droplets on said substrate on said support; and an enclosure structure defining with said support an enclosed region through which said droplets are ejected onto said substrate, said enclosure structure also defining with said support an inlet gap and an outlet gap through which said substrate travels, said enclosure structure comprising an enclosure disposed above said droplet ejection assembly, wherein the enclosure structure is configured to receive pressurized gas to provide a flow of gas from said enclosure structure through the gaps.

29. The apparatus of claim 28 wherein the support is continuous.

30. The apparatus of claim 29 wherein the continuous support comprises a porous platen.

31. An apparatus for depositing droplets on a substrate, the apparatus comprising:

a support for said substrate;

a droplet ejection assembly positioned over said support for depositing said droplets on said substrate on said support; and an enclosure structure defining with said support an enclosed region through which said droplets are ejected onto said substrate, said enclosure structure also defining with said support an inlet gap and an outlet gap through which said substrate travels, wherein said enclosure structure comprising a mainfold distribution system configured to deliver a pressurized gas to respective slits adjacent each gap.

32. The apparatus of claim 31 wherein the support is continuous.

33. The apparatus of claim 29 wherein the continuous support comprises a porous platen.

* * * * *

UNITED STATES PATENT AND TRADEMARK OFFICE

CERTIFICATE OF CORRECTION

PATENT NO. : 6,997,539 B2
APPLICATION NO. : 10/462093
DATED : February 14, 2006
INVENTOR(S) : Paul A. Hoisington, Melvin L. Biggs and Andreas Bibl It is certified that error appears in the above-identified patent and that said Letters Patent is hereby corrected as shown below:

Cover Page (73):

Under assignee, please add --Heidelberger Druckmaschinen AG, Heilelberg, Fed Rep Germany--as an additional assignee.

Signed and Sealed this

Twelfth Day of September, 2006

JON W. DUDAS
*Director of the United States Patent and Trademark Office*